United States Patent [19]

Sakamoto et al.

[11] Patent Number: 4,862,209

[45] Date of Patent: Aug. 29, 1989

[54] IMAGE FORMING APPARATUS HAVING A REMOVABLE IMAGE FORMING PROCESS KIT

[75] Inventors: Koji Sakamoto, Tokyo; Misao Tanzawa, Kawasaki, both of Japan

[73] Assignee: Ricoh Company, Ltd., Tokyo, Japan

[21] Appl. No.: 164,134

[22] Filed: Mar. 4, 1988

[30] Foreign Application Priority Data

Mar. 5, 1987 [JP] Japan ..... 62-48690
Mar. 5, 1987 [JP] Japan ..... 62-48691
Mar. 5, 1987 [JP] Japan ..... 62-48693

[51] Int. Cl.[4] ..... G03G 21/00; G03G 15/00
[52] U.S. Cl. ..... 355/211; 355/298
[58] Field of Search ..... 355/3 R, 3 DD, 3 DR, 355/3 BE, 15

[56] References Cited

U.S. PATENT DOCUMENTS 4,376,577 3/1983 Okamoto ..... 355/3 DR
4,376,579 3/1983 Wakao ..... 355/3 DR
4,386,841 6/1983 Wakao et al. ..... 355/3 DR
4,583,832 4/1986 Kasamura et al. ..... 355/3 DD
4,609,276 9/1986 Mitzutani ..... 355/3 DR X
4,678,318 7/1987 Bisaiji ..... 355/15
4,760,424 7/1988 Ohba et al. ..... 355/3 R
4,791,454 12/1988 Takahashi et al. ..... 355/15
4,796,057 1/1989 Howard et al. ..... 355/15

*Primary Examiner*—Fred L. Braun
*Attorney, Agent, or Firm*—Oblon, Spivak, McClelland, Maier & Neustadt

[57] ABSTRACT

An image recorder includes a cleaning unit having an opening which faces a photoconductive drum in a predetermined set position of the unit, and other process units which are arranged around the drum together with the cleaning unit. A process kit which at least includes the cleaning unit is removable from the image recorder independently of the drum. The image recorder is constituted by an upper and a lower unit, the upper unit being openable away from the lower unit. A member is provided which opens and closes the opening of the cleaning unit in an interlocked relation with the upper unit. The drum and process kit may be opened and closed together with the upper unit or, alternatively, the process unit may be opened and closed together with the upper unit with the drum retained by the lower unit, as desired.

17 Claims, 12 Drawing Sheets

IMAGE FORMING APPARATUS HAVING A REMOVABLE IMAGE FORMING PROCESS KIT

BACKGROUND OF THE INVENTION

The present invention relates to an image recorder having a charging unit, an exposing unit, a developing unit, a transferring unit, a cleaning unit and other image forming process units which are arranged around a photoconductive element which may be implemented with a drum or a belt.

With the spread of image recorders such as a laser printer and a facsimile machine, there has recently been developed a personal image recorder which allows a user not only to supply toner, or developed, but also to replace a photoconductive element and a cleaning unit without the help of a serviceman. This kind of image recorder usually includes a photoconductive element, and a charging unit, a cleaning unit and other image forming process units which are arranged around and constructed integrally with the photoconductive element. When a predetermined period of time expires, when any of such units fails, when the developer runs out, or when the cleaning unit becomes full of toner collected, those units which are unitary with each other are bodily removed from the image recorder and individually replaced with new ones. This replacement system, however, has some problems left nusolved, as follows. The cost per replacement with respect to the individual structural elements is high increasing user's burden. Since the lives of the photoconductive element, developing unit, cleaning unit and others are different from each other, the photoconductive element, for example, which is comparatively expensive has to be discarded when the lives of the developing and cleaning units expire even if it is still usable. Such wastage adds to the cost per print.

In the light of the above, there has been proposed an image recorder in which the major process units other than the photoconductive element are contructed into a single kit. This kit is removable from the image recorder and replaced with a new one independently of the photoconductive element. A problem with this kind of image recorder is that when the kit is separated from the photoconductive element, toner collected in the cleaning unit is apt to be scattered around through an opening a collecting section of the unit because the opening is moved away from the photoconductive element, contaminating the interior of the image recorder. One approach for solving this problem is disclosed in, for example, in Japanese Laid-Open Utility Model Publication (Kokai) No. 57-195166. The approach disclosed in the Laid-Open Publication is such that a cleaning blade of a cleaning unit and a container adapted to store toner which is collected from a photoconductive element by the cleaning blade are constructed unitarily with each other. When the container is removed from the image recorder, the cleaning blade is elastically displaced and, in response to such a displacement of the cleaning blade, a closure member blocks the opening of the container. However, even this implementation fails to stop that part of toner which is deposited on the cleaning blade and its neighborhood. Another implementation is shown and described in Japanese Laid-Open Patent Publication (Kokai) No. 61-110168 and is comprised of an abutment member which, when a cleaning unit is moved away from a photoconductive element, closes an opening of a toner collecting section of the unit in place of the photoconductive element. This implementation, however, increases the overall dimensions of the image recorder while making the manual operation troublesome.

Another problem particular to an electrophotographic copier or the like designed for personal use is the removal of a paper jam. That is, when a paper jam occurs in such an image recorder, the user has to remove the jamming paper without the help of a serviceman. A clamshell structure is one approach to allow a person to remove a jamming paper, as well known in the art. Specifically, an image recorder with a clamshell structure is constituted by an upper and a lower unit which are located on opposite sides of a paper transport path. In this case, a photoconductive element and a process kit having other major process units therein are mounted in and movable integrally with the upper unit, facilitating easy removal of a jamming paper. In the clamshell structure, however, the process kit cannot be replaced with a new one unless the photoconductive element is temporarily taken out of the image recorder of the process kit itself is pulled out toward the person with the greatest possible care so as not to scratch the photoconductive element.

SUMMARY OF THE INVENTION

It is, therefore, an object of the present invention to provide an image recorder in which a photoconductive element and a process kit having other major process units therein are removable independently of each other and, in addition, a jamming paper is removable with ease.

It is another object of the present invention to provide an image recorder in which a photoconductive element and a process kit having other major process units therein are removable independently of each other and, in a condition wherein they are spaced apart from each other, an opening of a cleaning unit is blocked to prevent a developer from being scattered around.

It is another object of the present invention to provide a generally improved image recorder.

An image recorder having an image carrier and a plurality of process units which are arranged around the image carrier, the image carrier and process units being individually removably mounted in a body of the image recorder which is constituted by an upper and a lower unit, the upper unit being openable away from the lower unit of the present invention comprises a processes kit constituting the upper unit and in which the process units are assembled integrally with each other, and a control means for controlling opening and closing movements of the upper unit relative to the lower unit.

BRIEF DESCRIPTION OF THE DRAWINGS

The above and other objects, feature and advantages of the present invention will become more apparent from the following detailed description taken with the accompanying drawings in which.

DESCRIPTION OF THE PREFERRED EMBODIMENTS

Referring to FIGS. 1 to 5 of the drawings, there is shown an image recorder in accordance with the present invention in which a photoconductive element and a unitary process kit constituted by major process units other than the photoconductive element are removably independently of each other, and which promotes easy removal of a jamming paper. Particularly, the image recorder shown in the figures is an electrophotographic copier of the type moving an original document relative to optics.

Figure 1:
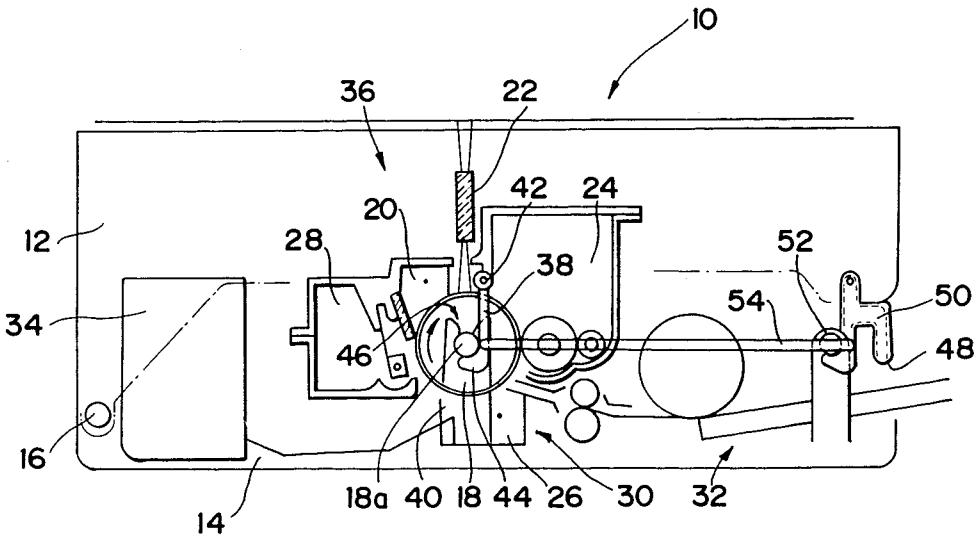
FIG. 1 is a sectional side elevation of an electrophotographic copier which is representative of one embodiment of the image recorder in accordance with the present invention.
Figure 2:
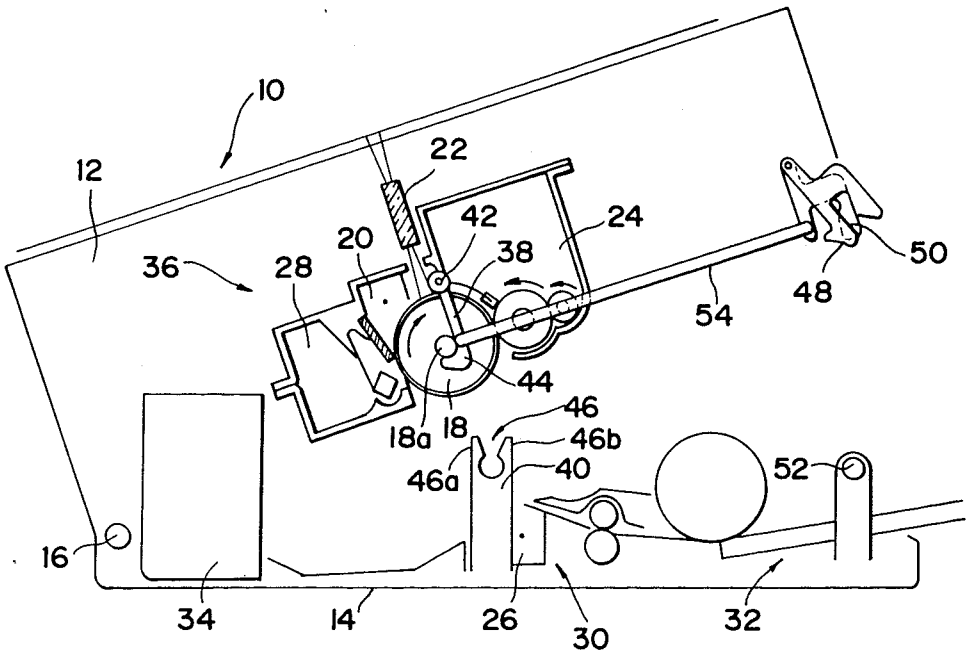
FIGS. 2 and 3 are sectional side elevations demonstrating the operation of the copier as shown in FIG. 1.
Figure 3:
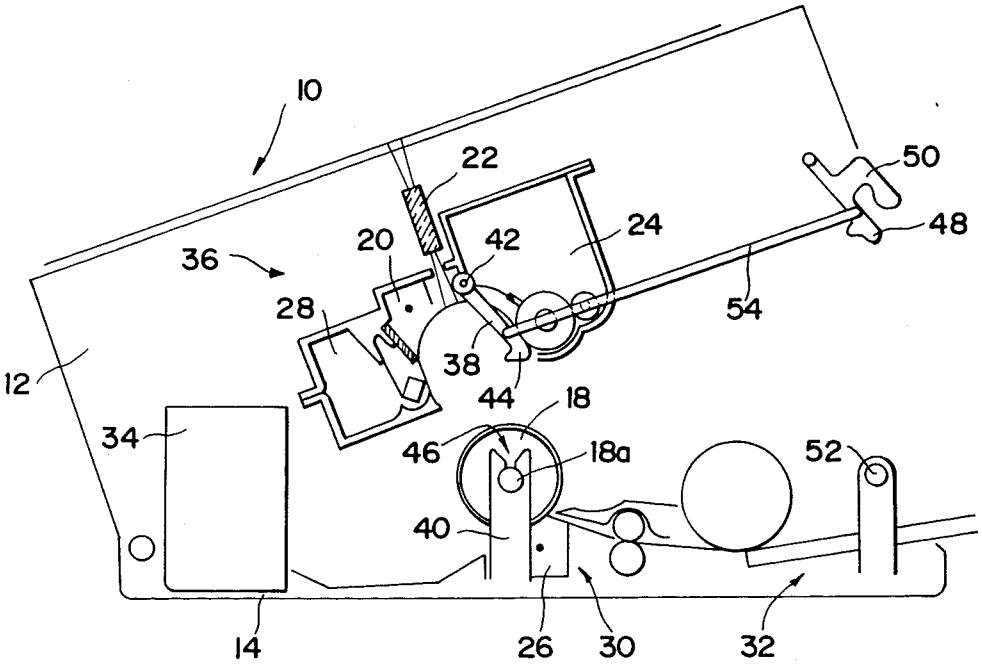

As shown, the copier, generally 10, is made up of an upper unit 12 and a lower unit 14 which are pivotally connected to each other by a shaft 16 at the left end thereof as viewed in FIGS. 1 to 3. Specifically, the upper and lower units 12 and 14 are shown in a closed position in FIG. 1, in an open position in FIG. 2 which is adapted to remove a jamming paper, and in another open position in FIG. 3 which is adapted to replace the process kit or the photoconductive element. The photoconductive element takes the form of a drum 18. Sequentially arranged around the drum 18 are a charger 20, optics 22 for exposure, a developing unit 24, a transfer charger 26, and a cleaning unit 28. A transfer unit 30 is interposed between the transfer charger 26 and the drum 18. A paper sheet is fed from a paper feed unit 32 to the transfer unit 30 so that a toner image produced on the drum 18 by the above-stated various process units is transferred to the paper sheet. The toner image on the paper sheet is fixed by a fixing unit 34 to complete a copying procedure, whereafter the paper sheet is driven out of the copier 10.

Removably mounted in the copier upper unit 12 are the optics 24 and a process kit 36 which includes the charger 20, developing unit 24 and cleaning unit 28. In the position shown in FIG. 1, opposite ends **18*a* of a shaft of the drum 18 are each supported by a first hook member 38 and a second hook member 40. Specifically, the first hook member 38 is journaled to the upper unit 12 by a shaft 42 at its upper end and provided with a hook portion 44 at its lower end. The second hook member 40 is fixed to the lower unit 14 at its lower end and provided with a catch portion 46 at its upper end, the catch portion 46 being comprised of a pair of resilient fingers 46*a* and 46*b*. Each shaft end 18*a* is retained by the hook portion 44 of the first hook member 38 and then by the catch portion 46 of the second hook member 40**.

Figure 4:
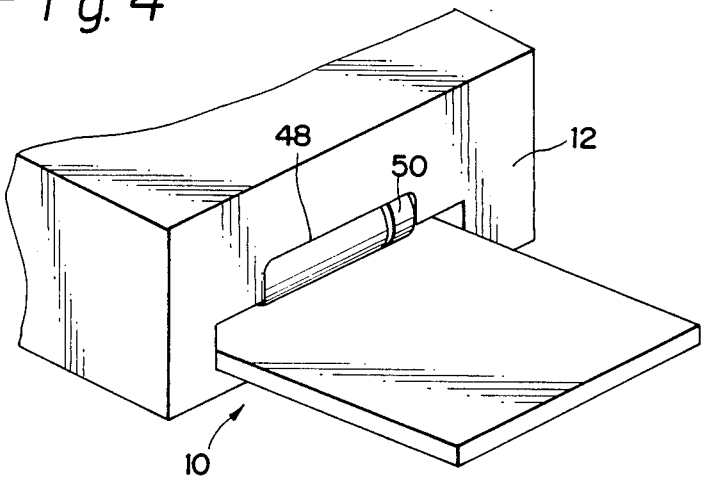
FIGS. 4 and 5 are perspective views showing an open-close operating section and an interlocking mechanism which are included in the copier of FIG. 1.
Figure 5:
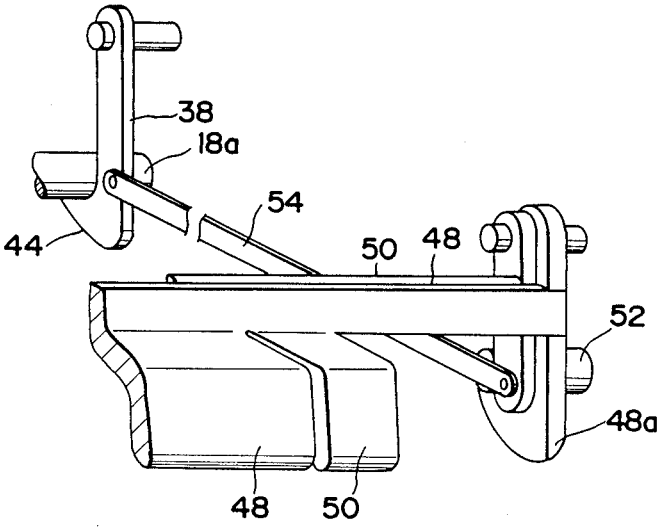

As shown in detail in FIGS. 4 and 5, an A lever 48 and a B lever 50 are disposed at the right end of the copier upper unit 12. As shown in FIG. 5, the A lever 48 includes a hook portion **48*a* which is engageable with a pin 52 which is in turn studded on the copier lower unit 14, and the B lever 50 is operatively connected to the first hook member 38 by a link 54. In this construction, when the A lever 48 only is pulled, the hook portion 48*a* of the A lever 48 is released from the pin 52 to allow the copier upper unit 12 to be bodily moved upward away from the copier lower unit 14, as shown in FIG. 2. As the copier upper unit 12 is raised so, the first hook member 38 hooking the shaft of the drum 18 is released from the resilient fingers 46*a* and 46*b* of the second hook member 40 against the action of the latter, resulting that the process kit 36 is moved upward together with the upper unit 12. This exposes a paper transport path of the copier 10** to the outside to promote easy access for the removal of a jamming paper.

Assume that the copier upper unit 12 is raised by pulling both the A and B levers 48 and 50. Then, B lever 50 moves the first hook member 38 away from the shaft of the drum 18 and, therefore, the drum 18 is left on the copier lower unit 14 with its shaft end **18*a* caught by the second hook member 40. In this condition, the drum 18 and/or the process kit 38 can be replaced without interfering with each other. With respect to the motion of the A lever 48, the B lever 50 is preferably be designed with some play which causes the hook portion 48 of the A lever 48 to begin its movement only after the first hook member 38 has moved by a certain amount. Then, the copier upper unit 12 will surely be raised after the drum 18 has been fully released from the first hook member 38**.

As described above, this particular embodiment allows even a user of the copier 10 to readily remove a jamming sheet and to replace the drum 18 and process kit 38 as needed.

Hereinafter will be described another embodiment of the present invention applicable to the above-described type of image recorder and provided with an implementation for preventing toner, which is collected from an opening of a cleaning unit of a process kit, from being scattered around when a photoconductive drum and the process kit are moved away from each other. In the alternative embodiment, the same or similar structural elements as those of the first embodiment are designated by the like reference numerals.

Figure 6:
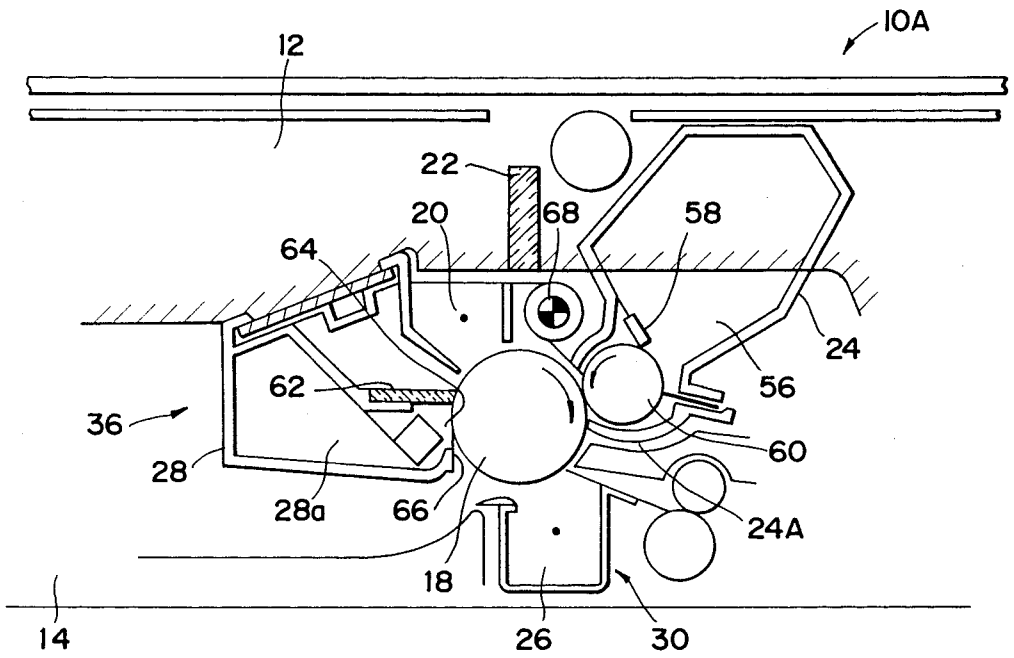
FIG. 6 is a sectional side elevation showing a photoconductive element and its neighborhood of an electrophotographic copier which is respresentative of another embodiment of the present invention.

Specifically, FIG. 6 shows a copier 10A which is provided with such an implementation. Again, the copier 10A includes the drum 18, charger 20, optics 22, developing unit 24, transfer charger 26, and cleaning unit 28. The developing unit 24 which is of the type using a single component developer stores toner 56 therein. The toner 56 is regulated by a doctor blade 58 to a thin layer and then transported by a developing roller 60 to the drum 18, wherby an electrostatic latent image formed on the drum 18 is developed to become a toner image. While the toner image is transferred to a paper sheet by the transfer charger 26, that part of the toner which remains on the drum 18 after the image transfer is removed by a cleaning blade 62 of the cleaning unit 28 to be collected in a toner collecting section 28*a*. The toner collecting section 28*a* is provided with an opening 64 in that part thereof which faces the drum 18. Opposite ends of the toner collecting section 28*a* with respect to the direction of rotation of the drum 18 are fully sealed by a seal member 66 and the cleaning blade 62 which makes sliding contact with the drum 18, preventing the toner collected in the section 18*a* from dropping therefrom into the interior of the copier 10A.

Figure 7:
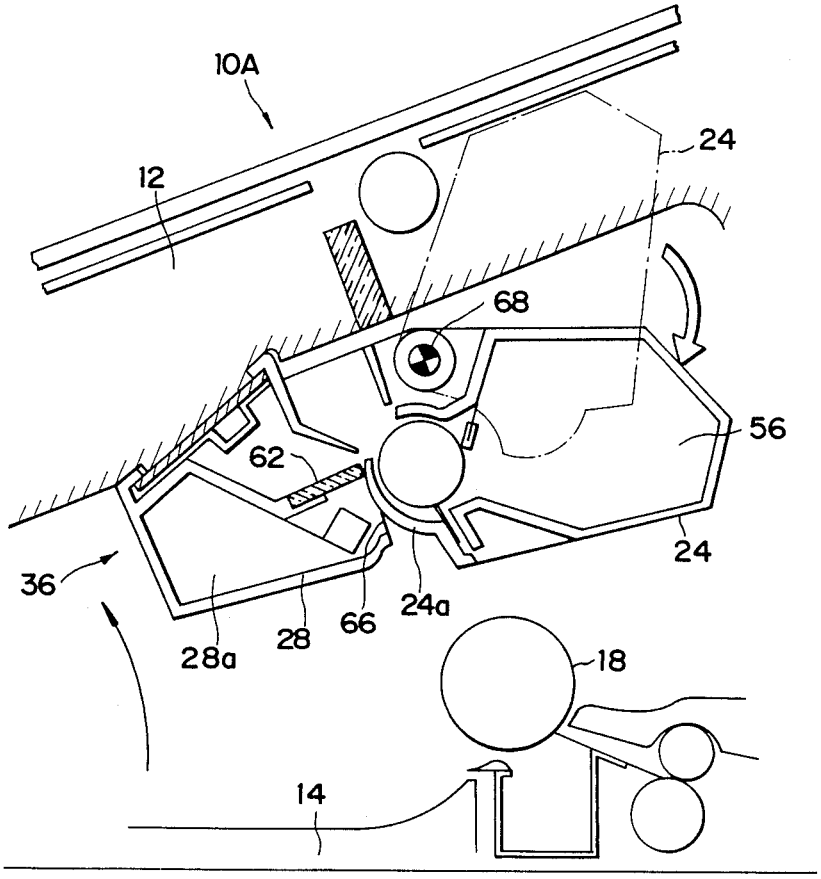
FIG. 7 is a sectional side elevation demonstrating the operation of the copier as shown in FIG. 6.

As in the first embodiment, the upper and lower units 12 and 14 of the copier 10A are rotatable away from each other, and the drum 18 is removably journaled to the lower unit 14. The process kit 36 made up of the cleaning unit 28, charger 20 and developing unit 24 is removably mounted on the copier upper unit 12 which is indicated by hatching in FIG. 6. Although not shown in FIG. 6, the copier upper and lower units 12 and 14 are pivotally connected to each other by the shaft 16 at the left end thereof and, therefore, their right ends are movable away from each other, as shown in FIG. 7. In the illustrative embodiment, the developing unit 58 included in the process kit 36 is rotatably mounted on a shaft 68 which extends parallel to the shaft of the drum 18. As shown in FIG. 7, when the copier upper unit 12 is rotated about the shaft 16 away from the copier lower unit 14, the process kit 36 is raised together with the upper copier unit 12 while, at the same time, the drum 18 is maintained on the lower unit 14. As the process kit 36 is moved clear of the drum 18 as stated, the developing unit 56 is rotated about the shaft 68 from a position indicated by a dash-and-dot line in FIG. 7 to a position indicated by a solid line in the same figure. In this condition, a bottom wall portion 24*a* included in a housing of the developing unit 24 is located to face the opening 64 of the cleaning unit 28. Since the outer surface of the bottom wall portion 24*a* is provided with substantially the same curvature as the drum 18, it fully closes the opening 64 of the cleaning unit 28 in cooperation with the seal member 66 and cleaning blade 62. Therefore, when the process kit 36 is moved into or out of the copier 10A or when the process kit 36 is shocked or tilted during movement of the drum 18 into or out of the copier 10A, the toner collected in the collecting section 28*a* of the cleaning unit 28 is fully prevented from being scattered around. In addition, the process kit 36 is compact in configuration and therefore easy to handle.

Figure 8:
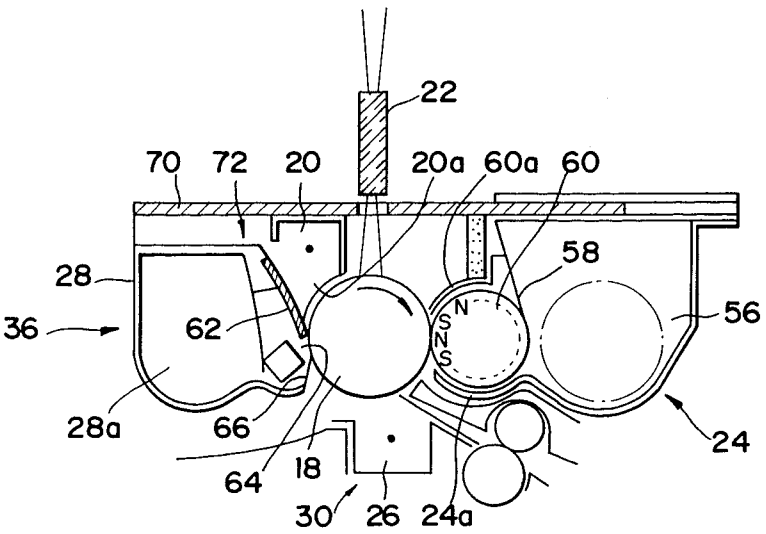
FIG. 8 is a sectional side elevation showing a photoconductive element and its neighborhood of an electrophotographic copier which is representative of another embodiment of the present invention.
Figure 9:
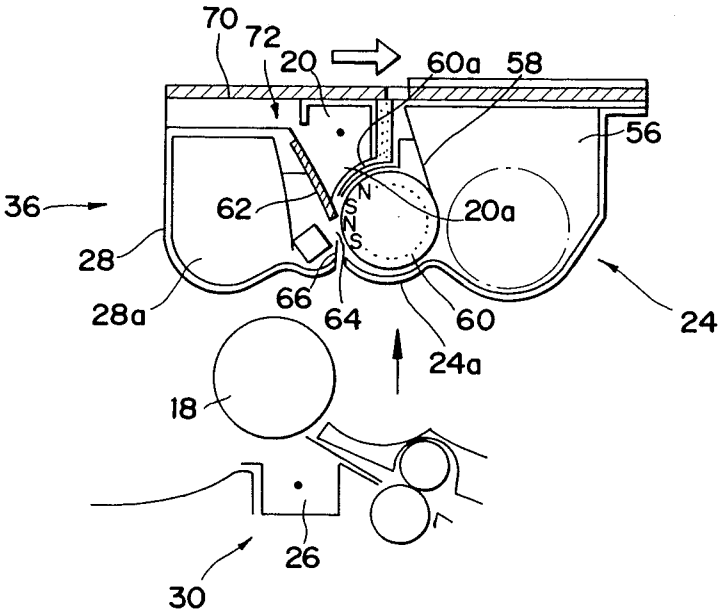
FIG. 9 is a sectional side elevation explaining the operation of the copier as shown in FIG. 8.

FIGS. 8 and 9 shows another specific implementation for eliminating the drop of collected toner from the cleaning unit 28. In these drawings, the same or similar structural elements as those of the previous embodiments are designated by the like reference numerals. As shown, the charger 20, optics 22, developing unit 24, transfer charger 26 and cleaning unit 28 are arranged around the drum 18. In this particular embodiment, the developing unit 24 is of the type using a developer which contains magnetic toner therein. As shown, the toner 56 regulated by the doctor blade 58 is transported to the drum 18 by the developing roller 60 in which magnets having different polarities are arranged. As shown in FIG. 8, the charger 20 and cleaning unit 28 which form a part of the process kit 36 are constructed into a unitary subassembly 72, as shown in FIG. 8. The developing unit 24 is movable toward and away from the charger and cleaning unit subassembly 72 along a guide rail 70 which is rigidly connected to the subassembly 72. The developing unit 24 is constantly biased by a spring, not shown, toward the cleaning unit 28. When the developing unit 24 is held in contact with the cleaning unit 28, the developing roller 60 of the unit 24 is located to close the opening 64 of the unit 28.

When the process kit 36 is pulled up in order to replace it, the charger and cleaning unit subassembly 72 and the developing unit 24 are moved toward each other to the position shown in FIG. 9. In the position of FIG. 9, an upper cover portion 60*a* associated with the developing roller 60 and the developing roller 60 stop up an opening 20*a* of the charger 20 and the opening 64 of the cleaning unit 28, respectively. Since the toner used with this embodiment is magnetic toner and since the developing roller 60 has magnets therein, extremely high sealability is achieved. Further, even when the developing unit 24 is spaced apart from the cleaning unit 28 as shown in FIG. 8, toner in the vicinity of the cleaning blade 62 is magnetically adhered to and carried away by the developing roller 60 and is therefore hardly allowed to drop from the cleaning unit 28. In addition, since the opening 64 of the cleaning unit 28 is hermetically closed by the developing roller 60 and the bottom wall portion 24*a* of the developing unit 24, substantially perfect toner seal is established in the condition shown in FIG. 9. From the sealability standpoint, it is preferable that the diameter of the developing roller 60 be substantially equal to or slightly smaller than that of the drum 18, and that the curvature of the upper cover 60*a* associated with the developing roller 60 be substantially equal to that of the drum 18.

Figure 10:
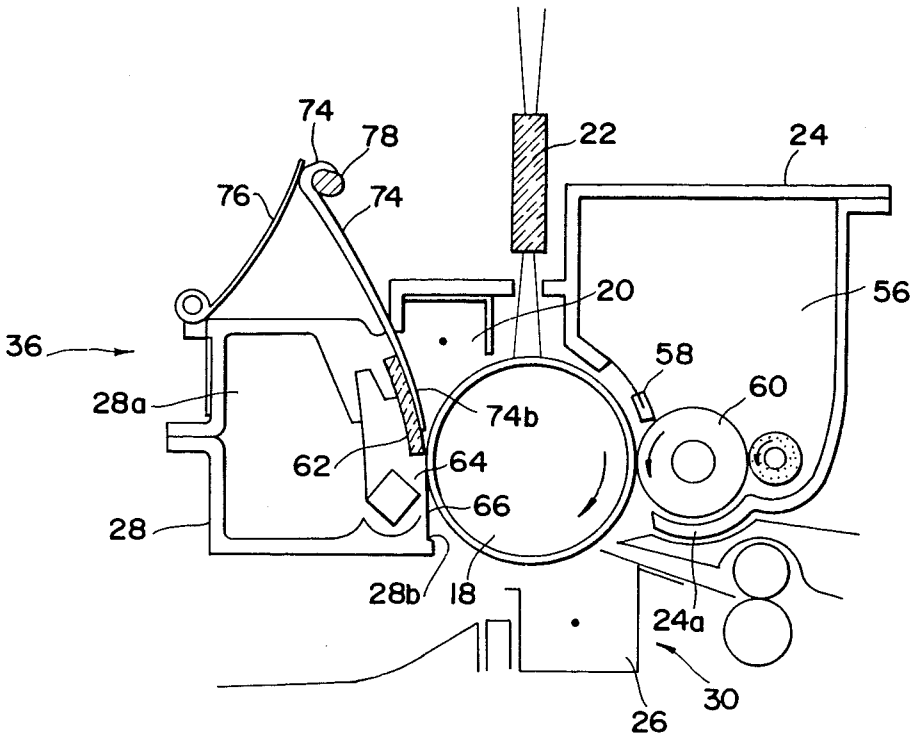
FIG. 10 is a sectional side elevation of a photoconductive element and its neighborhood of an electrophtographic copier which is representative of still another embodiment of the present invention.
Figure 11:
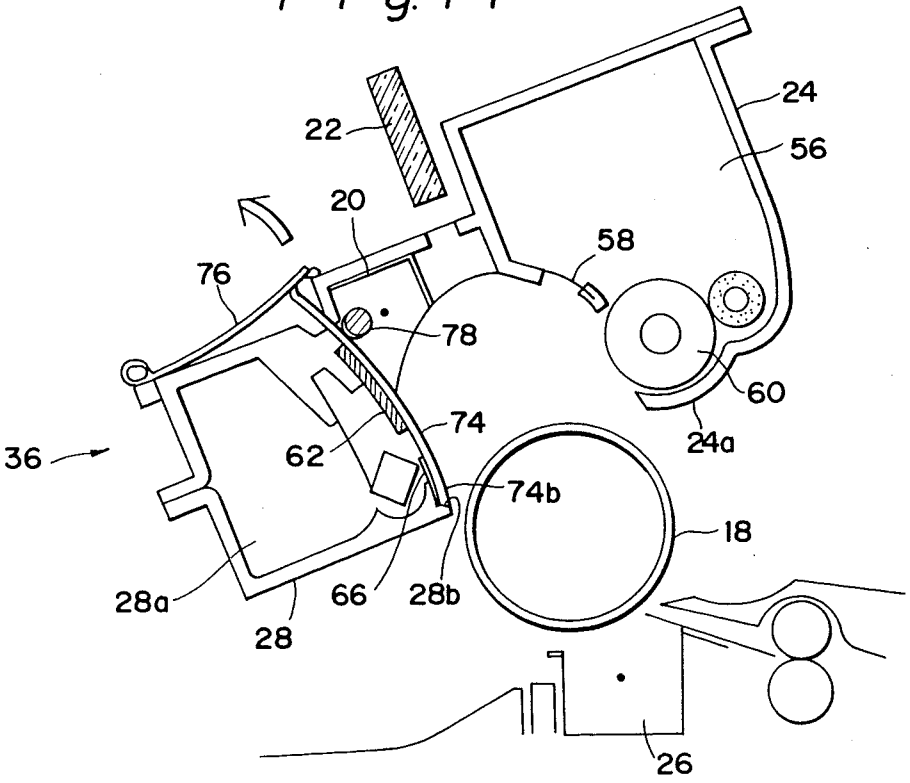
FIG. 11 is a sectional side elevation showing the operation of the copier of FIG. 10.

Referring to FIGS. 10 and 11, another embodiment of the present invention is shown which is provided with another specific implementation for preventing toner collecting from being scattered around from the cleaning unit 24. Again, the charger 20, optics 22, developing unit 24, charger 26 and cleaning unit 28 are sequentially arranged around the drum 18 in this order with respect to the direction of rotation of the drum 18 which is indicated by an arrow in FIG. 10. As in the previous embodiments, a copier, not shown, is made up of an upper and a lower unit which are pivotally connected to each other at their left end as viewed in the figures. When the copier upper unit is raised away from the copier lower unit as stated earlier, the interior of the copier is readily accessible for maintenance and other purposes. While the drum 18 is removably mounted on the lower unit, the process kit 36 which includes the charger 20, developing unit 24 and cleaning unit 28 is removably mounted on the upper unit. The construction and arrangement described so far is exactly the same as that of the previous embodiments. Hence, when the copier upper unit is moved upward away from the copier lower unit, the drum 18 shows itself from between the developing unit 24 and cleaning unit 28 of the process kit 36 which is raised together with the copier unit, as shown in FIG. 11. Then, the process kit 36 and the drum 18 are individually accessible.

Inside the developing unit 24, the doctor blade 58 extends from a developing unit housing to press itself against the developing roller 60 and thereby substantially prevents toner from dropping from the developing unit 24. However, when the process kit 36 is raised away from the drum 18 as previously stated, the opening 64 of the cleaning unit 28 becomes uncovered resulting that the toner collected in the collecting section 28*a* of the unit 28 is apt to drop therefrom. In this particular embodiment, a shutter member 74 which is implemented with a thin sheet is used to eliminate the drop of toner from the cleaning unit 28. The shutter member 74 is movable along the outer surface of the cleaning blade 62 of the cleaning unit 28 so as to block and unblock the opening 64 of the cleaning unit 28. The shutter member 74 is constantly biased downward, i.e., in a direction for closing the opening 64 by one end of a spring 76 the other end of which is rigidly connected to the housing of the cleaning unit 28. A pin 78 is studded on the copier lower unit and usually held in engagement with a hook portion 74*a* which is provided at the upper end of the shutter member 74. In the condition shown in FIG. 10, the pin 78 causes the shutter member 74 to unblock the opening 64 of the cleaning unit 28 by overcoming the action of the spring 76. However, when the copier upper unit is raised away from the copier lower unit to replace the process kit 36 or the drum 18, the process kit 36 is raised relative to the pin 78, as shown in FIG. 11. Stated another way, the pin 78 is lowered relative to the process kit 36 so that the shutter member 74 is pressed down along the outer surface of the cleaning blade 62 by the spring 76 while being guided by a channel, which is formed in a side wall of the process kit 36. This movement of the shutter member 74 is stopped when its the lower end 74*b* abuts against a stop portion 28*b* which is included in the cleaning unit housing, the shutter member 74 thus fully blocking the opening 64 of the cleaning unit 28. At this instant, the shutter lower end 74*b* moves along the cleaning blade 62 in such a manner as to trace the outer surface of the latter, preventing toner from being scattered around due to spring-back and others of the blade 62. When the process kit 36 is removed from the copier, the shutter member 74 fully stops up the opening 64 allowing the kit 36 to be replaced without the fear of toner being scattered around.

When the copier unit is closed after the replacement of the process kit 36, the new process kit 36 is lowered relative to the pin 78 so that the hook portion 74*a* of the shutter member 74 is caught by the pin 78. Consequently, the shutter member 74 is raised to unblock the opening 64 of the cleaning unit 28 while, at the same time, the cleaning unit 28 and the developing 24 come to hold the drum 18 therebetween, as shown in FIG. 10. The inner surface of the shutter member 74 which moves along the cleaning blade 62 is cleaned by the edge of the blade 62, preventing toner from being dropped from the cleaning unit 28.

Figure 12:
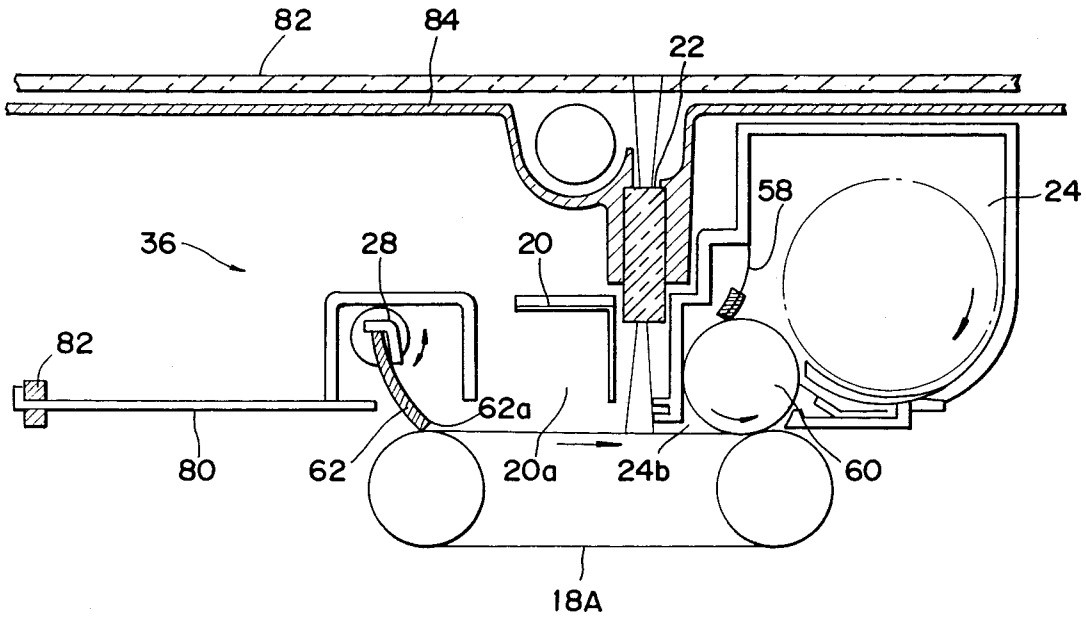
FIG. 12 is a sectional side elevation showing a photoconductive element and its neighborhood of an electrophotographic copier which is representative of a further embodiment of the present invention.
Figure 13:
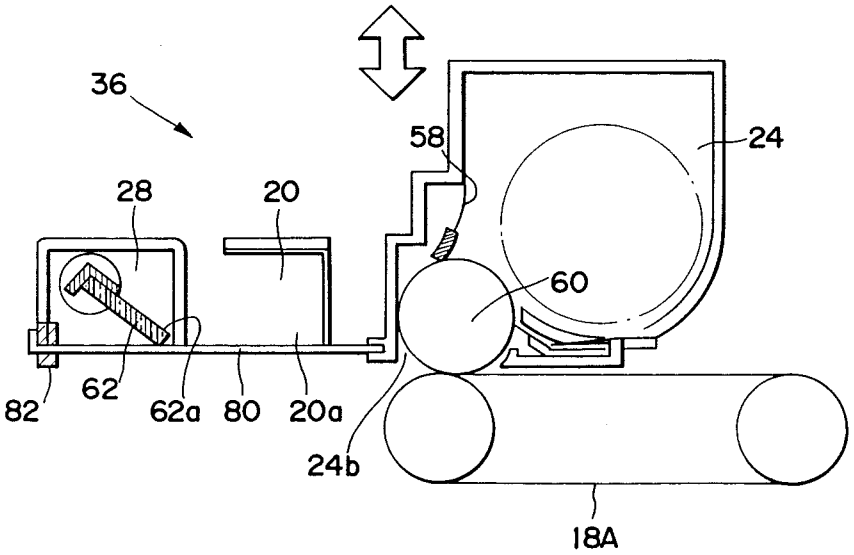
FIG. 13 is a sectional side elevation demonstrating the operation of the copier as shown in FIG. 13.

Referring to FIGS. 12 and 13, still another embodiment of the present invention is shown which uses an photoconductive belt 18A in place of the photoconductive drum 18. The cleaning unit 28, charger 20, optics 22 and developing unit 24 are sequentially arranged along the upper run of the belt 18A and in this order with respect to an intended direction of movement of the belt 18A. Again, the process kit 36 is constituted by the cleaning unit 28, charger 20 and developing unit 24. The cleaning unit 28 is different from those of the previous embodiments in that it lacks the toner collecting mechanism and, instead, uses a mechanism wherein the cleaning blade 62 is retracted away from the belt 18A while an image is not formed. Specifically, when the cleaning blade 62 is retracted so, toner having been blocked by the tip 62*a* of the blade 62 is unblocked to be returned to the developing unit 24 for reuse. In this kind of copier, the shutter mechanism is constituted by a shutter member 80 which is slidable along a guide channel provided in the process kit 36 so as to close the bottom of the kit 36, and a pin 82 studded on a side panel of the copier. When the optics 22 is raised together with a glass platen 82 and an upper cover 84 (see FIG. 12) with the intention of removing the process kit 36, the process kit 36 is moved leftward as viewed in FIG. 12 to reach a position of FIG. 13. In the position shown in FIG. 13, the process kit 36 may be pulled upward out of the copier. As the upper cover 84 is closed with a new process kit put in the copier in the position shown in FIG. 13, the new process kit is slid rightward to a predetermined set position.

The shutter member 80 is engaged with the pin 82 at its left end. Upon the movement of the process kit 36 to the position shown in FIG. 13, the shutter member 80 slides relative to the process kit 36 blocking the opening of the cleaning unit 28 and the opening 20*a* of the charger 20. While the process unit 36 is sequentially move leftward away from the set position, the cleaning blade 62*a* which has been retracted from the drum 18A and received in the cleaning unit 28 in the non-image-forming mode and, hence, it does not interfere with the shutter member 80 at all.

As stated above, during the movement of the process kit 36 into and out of the copier the opening 64 of the cleaning unit 28 is closed by the shutter member 80. In such a condition, a person can easily replace the process kit 36 without touching even a small amount of toner which may have been deposited on the tip 62*a* of the cleaning blade 62. It will readily occur to a person skilled in the art to modify this embodiment such that the shutter member 80 blocks an opening 24*b* of the developing unit 24 in addition to the opening 64 of the cleaning unit 28 and the opening 20*a* of the charger 20.

While the present invention has been shown and described in relation to an electrophotographic copier, it is of course applicable to any other image forming apparatus of the type having a cleaning unit, a photoconductive element, a developing unit and others, e.g. facsimile machine and printer. The present invention is applicable even to a printer, a facsimile machine or like apparatus of the kind having a sheet feed section which is provided in a lower section of the apparatus to facilitate miniaturization of the apparatus and easy replacement of a photoconductive element and others, a toner image being transferred to the lower surface of a paper sheet which is transported through a U-turn path.

Various modifications will become possible for those skilled in the art after receiving the teachings of the present disclosure without departing from the scope thereof.

What is claimed is:

1. An image recorder having an image carrier and a plurality of process units which are arranged around said image carrier, said image carrier and said process units being individually removably mounted in a body of said image recorder which is constituted by an upper and a lower unit, said upper unit being openable away from said lower unit, said image recorder comprising:

a process kit constituting said upper unit and in which said process units are assembled integrally with each other; and control means for controlling opening and closing movements of said upper unit relative to said lower unit wherein said process units comprise a cleaning unit having a collecting section which stores a developer collected from said image carrier and has an opening which faces said image carrier and wherein said image recorder further comprises a closure means interlocked with an opening movement of said upper unit relative to said lower unit for blocking said opening of said cleaning unit.

2. An image recorder as claimed in claim 1, wherein said image carrier comprises a photoconductive drum.

3. An image recorder as claimed in claim 1, wherein said image carrier comprises a photoconductive belt.

4. An image recorder as claimed in claim 1, wherein said control means comprises first open-close control means for, when said upper unit is opened and closed relative to said lower unit, causing said image carrier and said process kit which constitutes said upper unit to close and open integrally relative to said lower unit, and second open-close control means for, when said upper unit is opened and closed relative to said lower unit, causing said image carrier to be retained by said lower unit.

5. An image recorder as claimed in claim 1, wherein said process units further comprise a developing unit which includes developing roller means for supplying a developer to said image carrier.

6. An image recorder as claimed in claim 5, wherein said closure means comprises guide means for causing said developing roller means to move to said opening to block said opening.

7. An image recorder as claimed in claim 6, wherein said closure means further comprises a cleaning blade for collecting a developer remaining on said image carrier, and a seal member for guiding said developer collected toward said collecting section of said cleaning unit.

8. An image recorder as claimed in claim 6, wherein said developing unit further comprises a housing for storing said developer and said developing roller.

9. An image recorder as claimed in caim 8, wherein said guide means comprises a guide rail for supporting and guiding said housing of said developing unit.

10. A image recorder as claimed in claim 8, wherein said closure means comprises guide means for causing said housing of said developing unit to move to said opening to block said opening.

11. An image recorder as claimed in claim 10, wherein said guide means comprises a shaft fixed to said upper unit for allowing said housing of said developing unit to rotate about said shaft toward said opening.

12. An image recorder as claimed in claim 1, wherein said cleaning unit further comprises a housing which is formed with said opening, a cleaning blade for collecting said developer, and a seal member for guiding said developer collected toward said collecting section.

13. An image recorder as claimed in claim 12, wherein said closure means comprises a shutter member which is movable along an outer surface of said cleaning blade to block said opening in response to said opening movement of said upper unit.

14. An image recorder as claimed in claim 13, wherein said closure means further comprises biasing means for biasing said shutter member in a direction for blocking said opening.

15. An image recorder as claimed in claim 14, wherein said biasing means comprises a spring which is fixed at one end to said housing of said cleaning unit to bias said shutter member at the other end.

16. An image recorder as claimed in claim 15, wherein said closure means further comprises a stop against which an end of said shutter member abuts when said shutter member blocks said opening.

17. An image recorder as claimed in claim 16, wherein said stop is constituted by a part of said housing.

* * * * *